US006204446B1

(12) United States Patent
Parduhn

(10) Patent No.: US 6,204,446 B1
(45) Date of Patent: Mar. 20, 2001

(54) HANDHOLE COMPARTMENT

(76) Inventor: A. Philip Parduhn, 14501 Wilson Rd., Edmond, OK (US) 73013

( * ) Notice: Subject to any disclaimer, the term of this patent is extended or adjusted under 35 U.S.C. 154(b) by 0 days.

(21) Appl. No.: 09/364,729

(22) Filed: Jul. 30, 1999

(51) Int. Cl.[7] ..... E04H 12/24
(52) U.S. Cl. ..... 174/45 R
(58) Field of Search ..... 174/45 R; 52/726.4; 138/92

(56) References Cited

U.S. PATENT DOCUMENTS 3,624,269 11/1971 Latta .
3,808,504 * 4/1974 Rabie ..... 174/45 R
4,914,258 4/1990 Jackson .
5,524,411 6/1996 Crossman .

* cited by examiner

*Primary Examiner*—Shawn Riley
(74) *Attorney, Agent, or Firm*—Mary M. Lee

(57) ABSTRACT

A handhole compartment for utility poles. The compartment includes an oval sidewall sized to be received in the handhole, and a removable cover. The cover is equipped with a latch at each end. A foot on the end of the latch engages a notch in the sidewall. The foot is controlled by rotating the head of the latch on the top of the cover using an Allen wrench. The latch eliminates the need to align and thread bolts. The cover is molded plastic so that warping, common to metal covers, is virtually eliminated and so that the desired shape and size can be reproduced consistently. A lip on the edge of the cover provides a seal around the edge of the sidewall.

38 Claims, 6 Drawing Sheets

HANDHOLE COMPARTMENT

FIELD OF THE INVENTION

The present invention relates generally to compartments with removable covers and, more particularly, to handhole compartments for utility poles.

BACKGROUND OF THE INVENTION

Traffic control devices, street lights and other equipment supported on utility poles are supplied by wiring contained inside the pole. An access opening or "handhole"is provided in the side of the pole, usually about knee height, for accessing the wiring. Electrical connections, such as terminals and fuse disconnects, may be supported inside the handhole. These handholes are enclosed by covered compartments.

While conventional handhole compartments offer some protection against the elements, there is a need for improvement in the covers for these compartments. More specifically, there is a need for a cover design that resists deformation so that a good seal can be maintained for the life of the cover. There is also a need for a cover that can be opened and closed easily without having to align inside, non-visible components. Finally, there is a need for cover that can be manufactured uniformly and inexpensively.

SUMMARY OF THE INVENTION

The present invention comprises a handhole compartment for installation in the handhole of a utility pole. The compartment comprises a sidewall forming an enclosure sized to be received in the handhole. The sidewall has a front edge that defines a front access opening. At least one latch receiver is provided in the sidewall. A cover is included, the cover being sized to occlude the front access opening. The cover has a body portion circumscribed by an edge. A latch depends from the cover and comprises a foot movable between a latched position and an unlatched position. In the latched position, the foot non-threadedly engages the latch receiver in the sidewall to secure the cover over the access opening. In the unlatched position, the foot is disengaged from the latch receiver.

In another aspect, the invention is directed to a cover assembly for a handhole compartment comprising a sidewall having a front edge defining a front access opening and a latch receiver in the sidewall. The cover assembly comprises a cover sized to occlude the front access opening of the compartment, the cover having a body portion circumscribed by an edge. The cover assembly further comprises a latch depending from the cover and comprising a foot movable between latched position and an unlatched position. In the latched position, the foot non-threadedly engages the latch receiver in the sidewall to secure the cover over the access opening. In the unlatched position, the foot is disengaged from the latch receiver.

In yet another aspect, the present invention is directed to utility pole assembly. The utility pole assembly comprises a hollow shaft with a handhole in the side. The handhole is fitted with a compartment comprising a sidewall forming an enclosure sized to be received in the handhole, the sidewall having a front edge that defines a front access opening. At least one latch receiver is provided in the sidewall. Also included is a cover sized to occlude the front access opening, the cover having a body portion circumscribed by an edge. A latch depends from the cover and comprises a foot movable between a latched position and an unlatched position. In the latched position, the foot non-threadedly engages the latch receiver in the sidewall to secure the cover over the access opening. In the unlatched position, the foot is disengaged from the latch receiver.

DETAILED DESCRIPTION OF THE PREFERRED EMBODIMENT

Figure 1:
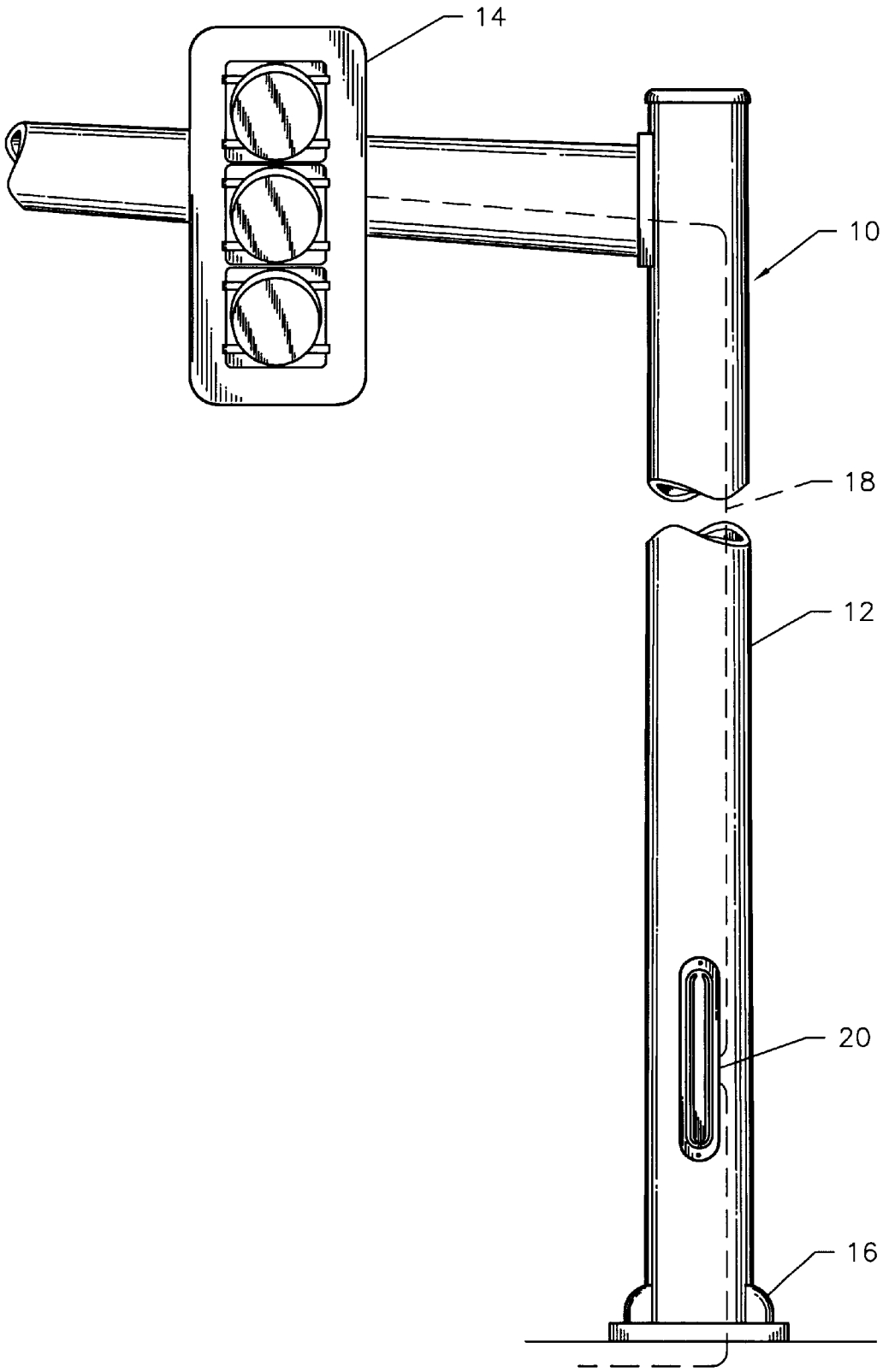
FIG. 1 is a front elevational view of a utility pole with a handhole compartment in accordance with the present invention.

Turning now to the drawings in general and to FIG. 1 in particular, there is shown therein a utility pole constructed in accordance with the present invention and designated generally by the reference numeral 10. The utility pole 10 comprises a vertically positioned, hollow shaft 12 on which a traffic control device, such as the traffic signal light 14, is mounted. As used herein, "traffic control device" refers to any signal, sign or device supported by or over or near a roadway, railroad, or walkway for affecting vehicular or pedestrian traffic, or both. This includes traffic signals and signs for controlling the direction and flow of automotive and railroad vehicles and pedestrian traffic, as well as warning devices, such as lights, signs and horns for all forms of vehicular and pedestrian traffic, such as railroad crossing signals.

At its bottom the pole 10 is supported by a base 16. The wiring 18, indicated in broken lines, which supplies the light 14 extends up through the shaft 12. The utility pole 10 is provided with a handhole compartment 20 through which the wiring 18 may be accessed.

Figure 2:
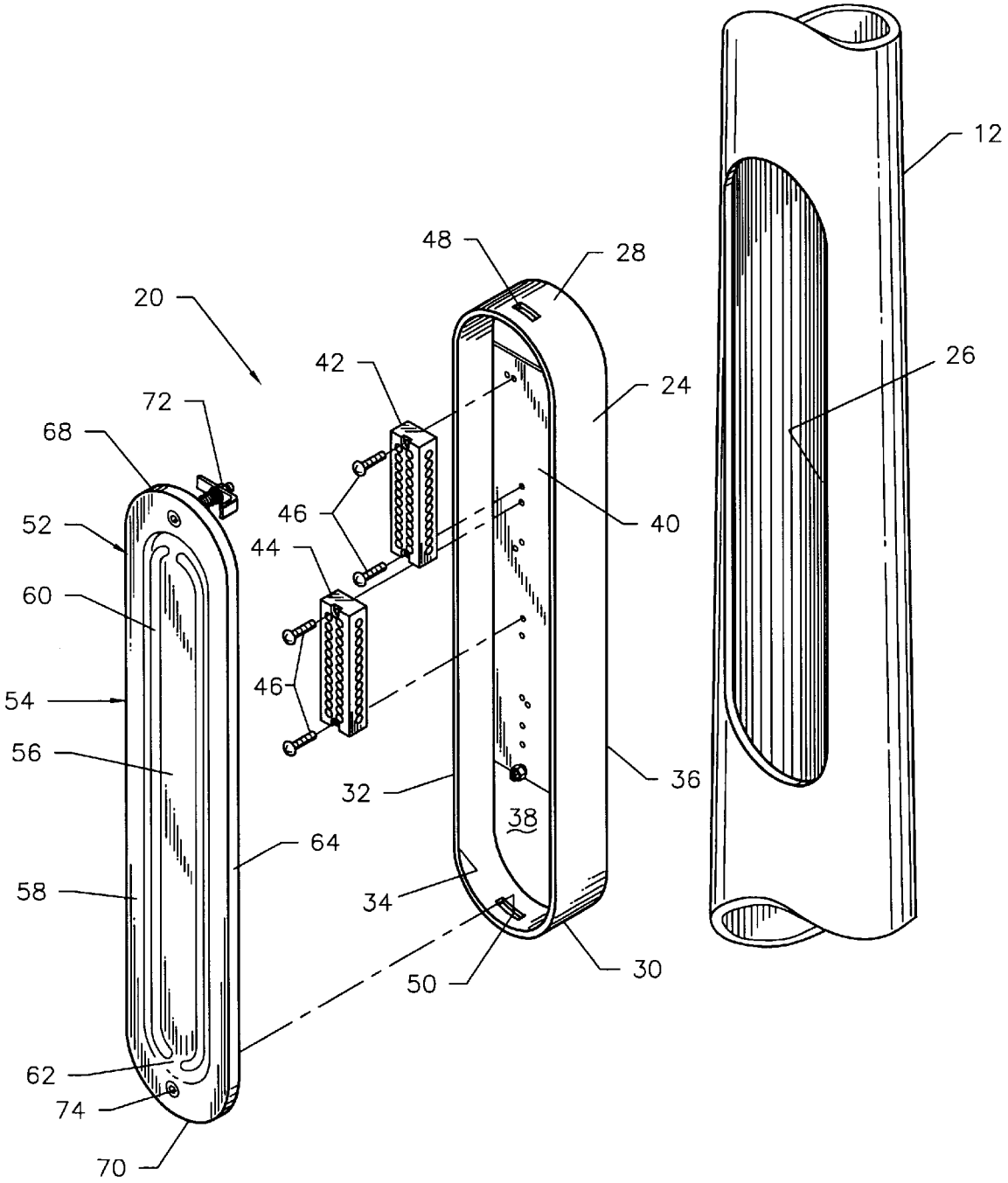
FIG. 2 is an enlarged, exploded perspective view of the handhole compartment seen in FIG. 1.

Turning now to FIG. 2, the handhole compartment 20 will be described. The compartment 20 comprises a sidewall 24 preferably formed of metal. The sidewall 24 forms an enclosure sized to be received in the handhole 26 of the shaft 12. As depicted in the drawings, most handholes in utility poles are elongated ovals. Thus, the sidewall 24 preferably is shaped likewise, forming an elongate enclosure with a first end 28 and a second end 30. The sidewall 24 has a front edge 32 forming a front access opening 34 and a rear edge 36 forming a rear opening 38.

The rear opening 38 may be completely open, partially occluded or fully occluded. In the embodiment shown, the rear opening 38 is partially occluded by a back plate 40. In most instances, it will be desirable to support one or more terminal blocks 42 and 44 inside the sidewall for connection to the wiring 18 supplying the traffic signal light 14 or other traffic control device (See FIG. 1). Other devices, such as fuse disconnects or luminaire fuses, may be utilized as well. The terminal blocks 42 and 44 preferably are mounted to the back plate 40 by screws 46 or in some other suitable fashion.

Referring still to FIG. 2, the sidewall 24 is provided with at least one latch receiver. In the case of the elongated oval compartment illustrated herein, the sidewall 24 is provided with two latch receivers, one at each of the first and second ends 28 and 30. Preferably, the latch receivers take the form of a slots 48 and 50.

The handhole compartment 20 further comprises a cover assembly 52 comprising a cover 54 sized to occlude the front opening 34. Preferably, the cover 54 is an elongated oval with a body portion 56 circumscribed by an edge 58. In the embodiments shown herein, the body portion 56 is generally planar, though a convex or concave body would serve equally well.

In the preferred practice of this invention, the cover 54 is integrally formed of plastic or metal, as by vacuum molding or stamping. Preferably, the cover 54 is provided with reinforcing ribs 60 and grooves 62. It is also advantageous to provide the edge 58 of the cover with a depending lip 64. The lip 64 is positioned to surround the front edge 32 of the sidewall 24 to provide a better seal against the elements. Although not shown herein, a compressible weatherproofing strip or seal member could be applied inside the lip 64 to improve the seal of the compartment still further.

With continuing reference to FIG. 2, at least one latch depends from the cover 54. In the embodiment herein, comprising an elongate cover 54 with two ends 68 and 70, two latches 72 and 74 are provided, one at each end, corresponding to the slots 48 and 50.

Figure 3:
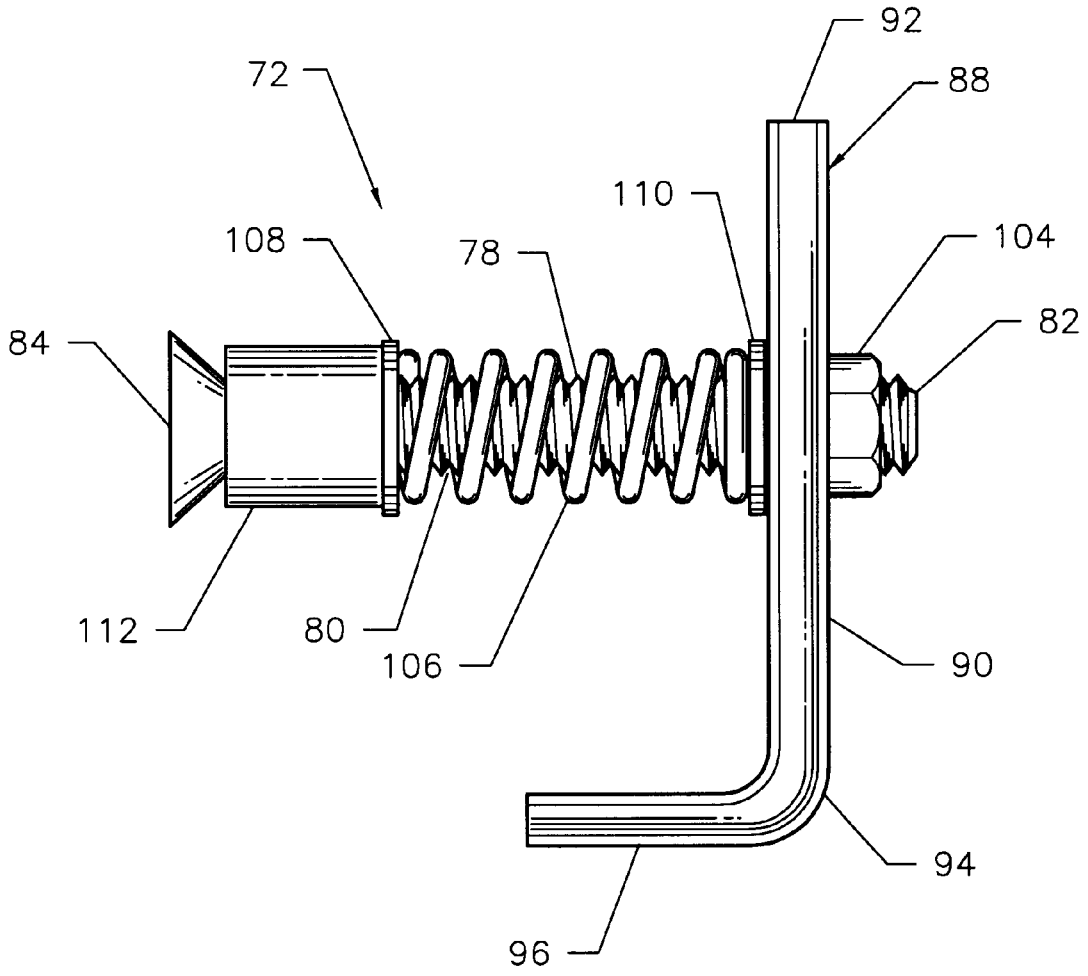
FIG. 3 is an enlarged, side elevational view of the latch of the handhole compartment of FIG. 1.
Figure 4:
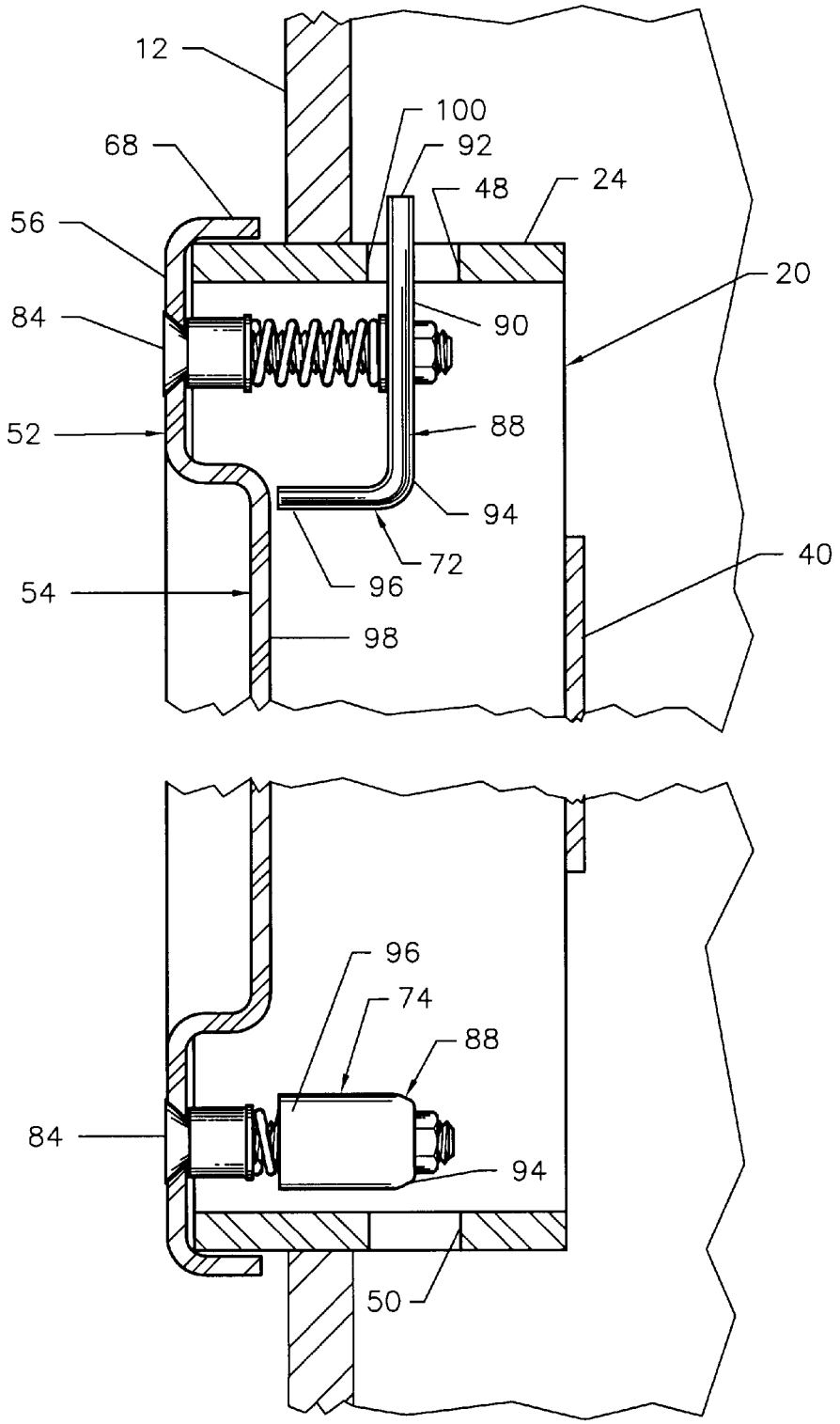
FIG. 4 is sectional, fragmented, side elevational view of the handhole compartment of FIG. 1.

The preferred latch is illustrated in FIGS. 3 and 4, to which attention now is directed. As the latches 72 and 74 are similarly formed, only one will be described in detail. The latch 72 comprises a stem 78, preferably threaded, with a first end 80 and a second end 82. The latch 72 depends from the cover 54 (FIG. 4). A head 84 is provided on the first end 80. The head 84 preferably is rotatably mounted in the body portion 56 of the cover 54.

The head 84 preferably is provided with a recess (not shown in FIG. 3) for receiving an Allen wrench for operating the latch 72 in a manner yet to be described. Of course, if a flat head screw driver is to be used, a slot or groove would be provided in the head of the latch. Similarly, a cross-groove would be used to accommodate a Phillips head screwdriver. Still further, a protrusion on the head could be provided, in lieu of the recess or slot, for use with a crescent wrench. Yet another alternative would be a handle of some sort permanently affixed to the head. As will now be understood, it is only necessary that the head be engageable from outside the compartment.

With continued reference to FIGS. 3 and 4, the latch 72 comprises a foot 88 movable between a latched position (see the latch 72 in FIG. 4) and an unlatched position (see the latch 74 in FIG. 4). The foot 88 preferably has a body 90 attached to the second end 82 of the stem 78. The foot 88 has a first end 92 and a second end 94. The first end 92 is adapted to non-threadedly engage the slot 48 (FIG. 4) to place the foot 88 in the latched position thereby securing the cover 54 over the front access opening 34 (FIG. 2). That is, the first end 92 of the foot 88 moves in and out of the slot 48 by simply rotating the head 84 of the stem 78. There is no need to align the end 92 with the slot 48. Rather, the end 92 is aligned with the slot 48 by the position and dimensions of the stem 78 and the foot 88. The second end 94 of the foot 88 terminates in an extension member 96 which extends upward toward the inside surface 98 of the cover 54 for a purpose which will become apparent.

The body 90 of the foot 88 preferably is threadedly engaged with the second end 82 of the stem 78 so that the foot can be moved longitudinally along the stem by rotating the stem relative to the foot. In this way, when stem 78 is rotated clockwise (when using a right-handed screw and viewed from outside the compartment) the foot 88 is rotated into the slot 48 until the end 92 of the foot engages the right side of the slot and cannot rotate further. Then, continued clockwise rotation of the stem 78 will draw the foot 88 upward on the stem thereby drawing the cover 54 into closer engagement with the sidewall 24. More specifically, as seen in FIG. 4, the first end 92 will be drawn toward engagement with the top edge 100 of the slot 48. Likewise, the extension member 96 will be drawn toward engagement with the inside surface 98 of the cover 54, keeping the foot 88 in stable, vertical alignment. This provides a snug fit between the cover 54 and sidewall 24 improving the seal therebetween.

Counter-clockwise rotation of the head 84 will move the foot 88 along the stem 78 away from the cover 54. When the frictional engagement between the end 92 of the foot 88 and the slot 48 is released, the foot will rotate with the stem 78 until the end 92 is out of the slot 48, disengaging the latch.

Referring still to FIGS. 3 and 4, the latch 72 may be provided with a nut 104 on the second end 82 of the stem 78 to prevent the foot 88 from coming off the stem. A coil spring 106 may be provided on the stem 78 between a first washer 108 and a second washer 110 near the first and second ends 80 and 82, respectively, of the stem 78. A spacer 112 may be provided between the inside surface 98 of the cover 54 and the first washer 108. The spring 106 should be sized to maintain a slight pressure between the washers 108 and 110, so as to maintain the foot 88 snugly between the washer 110 and the nut 104. This maintains the position of the foot 88 near the end 82 of the stem 78 when the latch 72 is disengaged. In this way, the end 92 of the foot 88 will be aligned with the slot 48 when it is desired to move the latch 72 into the engaged position.

Figure 5:
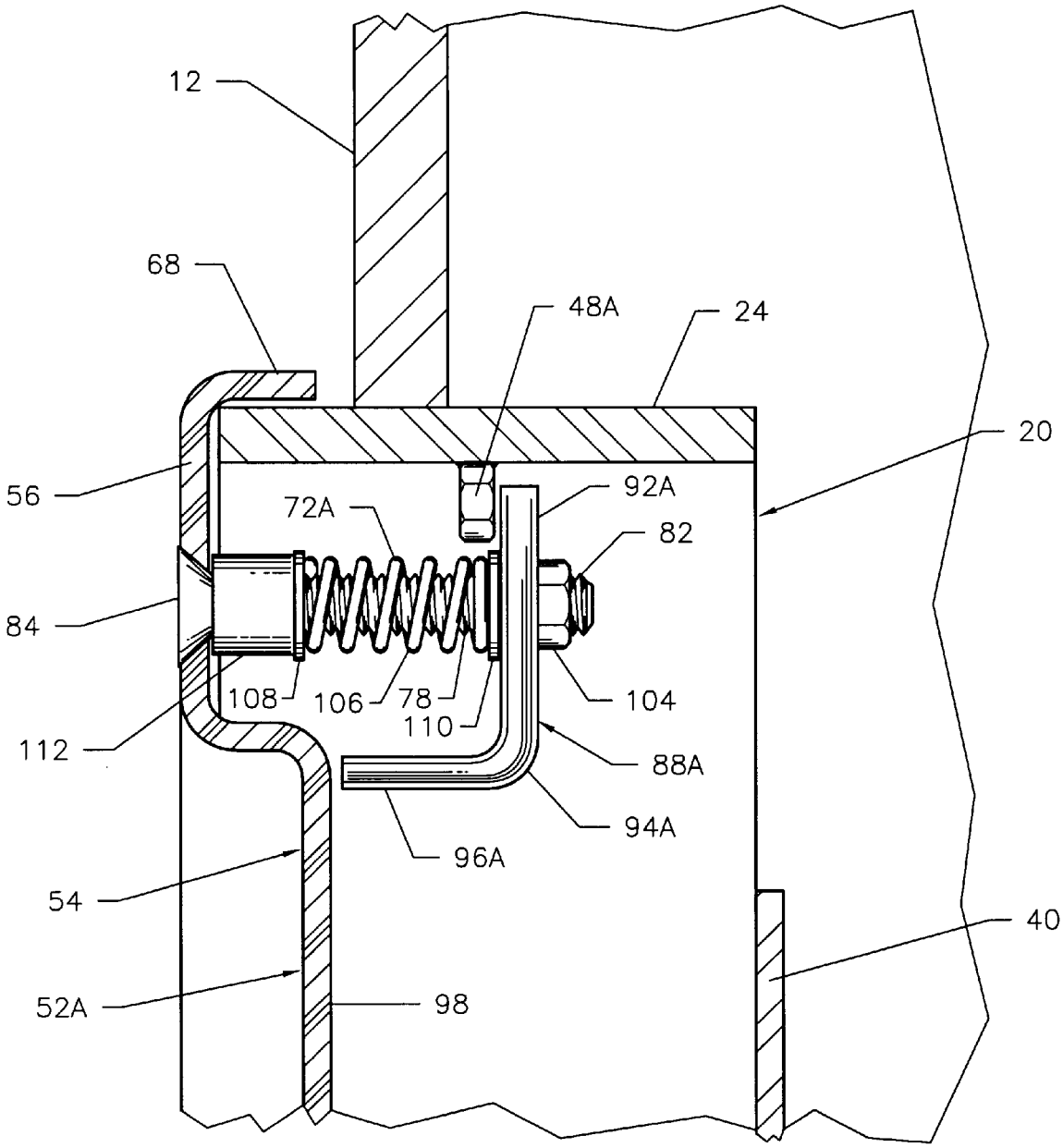
FIG. 5 is a partially cutaway, side elevational, sectional view of a second embodiment of the handhole compartment of the present invention showing the latch in the latched position. In this embodiment, the latch receiver is a nut welded to the inside surface of the sidewall.
Figure 6:
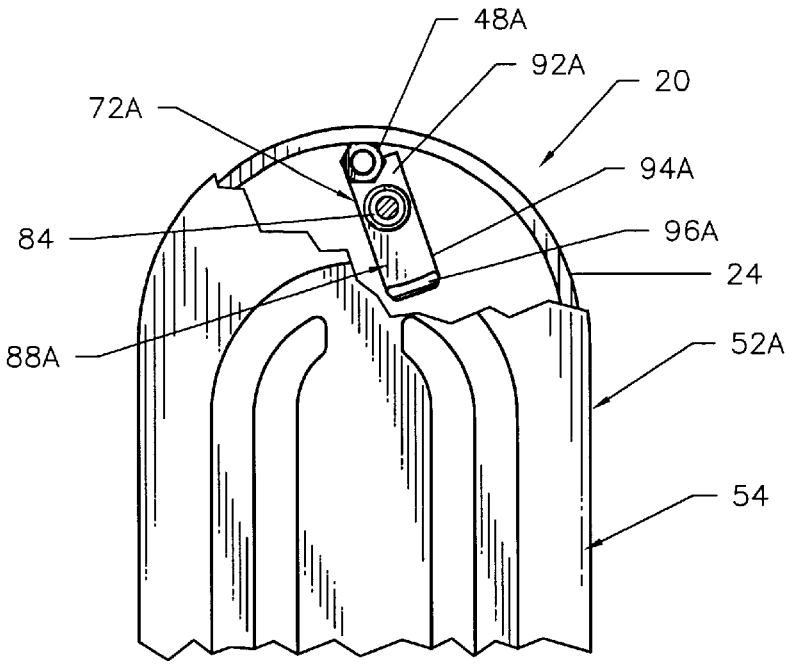
FIG. 6 is a fragmented, front view of the embodiment of FIG. 5 with the cover partially cut away to show the latch in the latched position.
Figure 7:
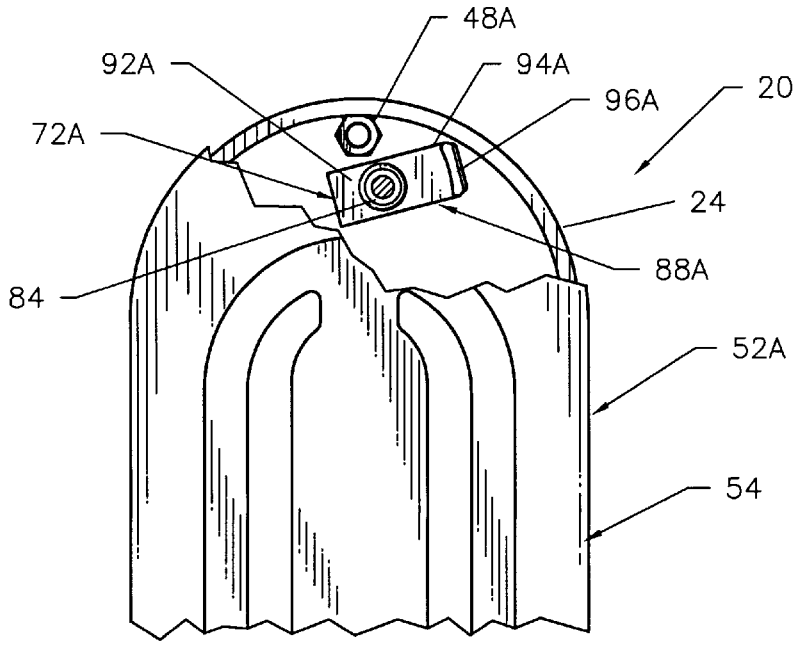
FIG. 7 is a fragmented, front view of the embodiment of FIG. 5 with the cover partially cut away to show the latch in the unlatched position.

Turning now to FIGS. 5, 6 and 7, another embodiment of the invention will be described. In this embodiment, the cover assembly 52A comprises a modified latch 72A that is designed to engage a latch receiver in the form of a protrusion inwardly extending from the sidewall 24. An example of such a protrusion is the nut 48A, which is welded to the inside of the sidewall 24 in many conventional handhole compartments. Thus, the present invention provides a cover assembly 52A that can be conveniently retrofitted to existing sidewalls.

In this embodiment, the cover 54 is similar to the cover 54 in the embodiment of FIGS. 2–4. The latch 72A comprises a threaded stem 78, head 84, nut 104, coil spring 106, washers 108 and 110, and spacer 112, all of which are formed similarly and function similarly to corresponding elements of the previous embodiment. As in the previous embodiment, the foot 88A comprises a first end 92A and a second end 94A with an extension member 96A. The foot 88A is threadedly mounted on the stem 78 as in the previous embodiment, and the extension member 96A is sized to engage the inner surface 98 of the cover when the latch 72A is engaged, also as previously described. The end 92A of the foot 88A is shorter than in the first embodiment, though, so as to fit under the nut 48A and inside the sidewall 24, as best seen in FIG. 5.

The operation of the latch 72A is illustrated in FIGS. 6 and 7. When the head 84 is rotated clockwise the end 92A moves to the right and engages the sidewall 24 under the nut 48A. As the head 84 is rotate further (see FIG. 5), the foot 88A is pulled upward on the stem 78 moving the end 92A into engagement with the nut 48A and the extension member 96A into engagement with the inside surface 98 of the cover 54. As shown in FIG. 7, the latch 72A is disengaged by rotating the head 84 counter-clockwise, which loosens the engagement of the foot 88A and rotates the end 92A away from the sidewall 24 and out from under the nut 48A.

Now it will be appreciated that the present invention provides a significant improvement in handhole compartments and particularly in cover assemblies for handhole compartments. The latch of this invention is self-guiding so that no manual alignment of internal, non-visible components is required to engage the latch. The latch is simple to operate from the outside of the compartment. The cover is provided with a depending lip that better encloses the compartment by overlapping the sidewall. The cover can be molded of plastic or stamped in metal sheets, so that the shape and configuration of the cover is uniformly reproducible. Similarly, covers so formed will maintain their original shapes longer and thereby provided a better seal over the access opening for the life of the cover. Advantageously, the latch can be modified easily to be retrofitted to the sidewalls of existing conventional compartments.

Changes can be made in the combination and arrangement of the various parts and elements described herein without departing from the spirit and scope of the invention as defined in the following claims.

What is claimed is:

1. A handhole compartment for installation in a handhole in a utility pole, the compartment comprising:

a sidewall forming an enclosure sized to be received in the handhole, the sidewall having a front edge that defines a front access opening; and at least one latch receiver in the sidewall;

a cover sized to occlude the front access opening, the cover having a body portion circumscribed by an edge;

a latch depending from the cover and comprising a foot movable between a latched position and an unlatched position, wherein in the latched position the foot non-threadedly engages the latch receiver in the sidewall to secure the cover over the access opening and so that in the unlatched position the foot is disengaged from the latch receiver.

2. The handhole compartment of claim 1 wherein the latch further comprises a stem having an first end and a second end, wherein the first end is rotatably attached to the cover, wherein the foot extends from the second end of the stem.

3. The handhole compartment of claim 2 wherein the foot is movable longitudinally along the stem and wherein the latch further comprises a coil spring on the stem between the cover and the foot whereby the foot is stabilized when in the unlatched position.

4. The handhole compartment of claim 2 wherein the latch further comprises a head on the first end of the stem, the stem extending through cover so that the head is accessible from the top of the cover, and wherein rotation of the head results in movement of the foot between the latched position and the unlatched position.

5. The handhole compartment of claim 4 wherein the stem is threadedly engaged with the foot so that when the foot is engaged in the latch receiver rotation of the head causes the foot to move up on the stem drawing the cover toward the sidewall, wherein the foot has a first end adapted to engage the latch receiver and a second end terminating in an extension member extending towards the cover, wherein the body portion of the cover has an inside surface, and wherein the extension member engages the inside surface of the cover when the cover is drawn toward the sidewall.

6. The handhole compartment of claim 1 wherein the latch receiver is a slot.

7. The handhole compartment of the claim 1 wherein the latch receiver is a protrusion extending inwardly from the sidewall.

8. The handhole compartment of claim 1 wherein a lip depends from the edge of the cover.

9. The handhole compartment of claim 1 wherein the sidewall has a read edge defining a rear opening.

10. The handhole compartment of claim 9 wherein the compartment comprises a back plate which at least partially occludes the rear opening.

11. The handhole compartment of claim 10 wherein the compartment comprises a terminal block supported on the back plate.

12. The handhole compartment of claim 9 wherein the compartment comprises a terminal block supported inside the sidewall.

13. The handhole compartment of claim 1 wherein the cover is integrally formed of molded plastic.

14. The handhole compartment of claim 1 wherein the sidewall forms an elongate enclosure with a first end and a second end, wherein the compartment comprises two latch receivers, one at each of the first and second ends of the enclosure, wherein the cover is elongated with a first and second end, and wherein the compartment comprises two latches, one at each of the first and second ends of the cover.

15. A cover assembly for a handhole compartment comprising a sidewall having a front edge defining a front access opening and a latch receiver in the sidewall, the cover assembly comprising:

a cover sized to occlude the front access opening of the compartment, the cover having a body portion circumscribed by an edge;

a latch depending from the cover and comprising a foot movable between latched position and an unlatched position, wherein in the latched position the foot non-threadedly engages the latch receiver in the sidewall to secure the cover over the access opening and so that in the unlatched position the foot is disengaged from the latch receiver.

16. The cover assembly of claim 15 wherein the latch further comprises a stem having a first end and a second end, wherein the first end is rotatably attached to the cover, wherein the foot extends from the second end of the stem.

17. The cover assembly of claim 16 wherein the foot is movable longitudinally along the stem and wherein the latch further comprises a coil spring on the stem between the cover and the foot whereby the foot is stabilized when in the unlatched position.

18. The cover assembly of claim 17 wherein the latch further comprises a head on the first end of the stem, the stem extending through cover so that the head is accessible from the top of the cover, and wherein rotation of the head results in movement of the foot between the latched position and the unlatched position.

19. The cover assembly of claim 18 wherein the stem is threadedly engaged with the foot so that when the foot is engaged in the latch receiver rotation of the head causes the foot to move up on the stem drawing the cover toward the sidewall, wherein the foot has a first end adapted to engage the latch receiver and a second end terminating in an extension member extending towards the cover, wherein the body portion of the cover has an inside surface, and wherein the extension member engages the inside surface of the cover when the cover is drawn toward the sidewall whereby the foot is stabilized.

20. The cover assembly of claim 15 wherein a lip depends from the edge of the cover.

21. The cover assembly of claim 15 wherein the cover is integrally formed of molded plastic.

22. The cover assembly of claim 15 wherein the sidewall forms an elongate enclosure with a first end and a second end, wherein the compartment comprises two latch receivers, one at each of the first and second ends of the enclosure, wherein the cover is elongated with a first and second end, and wherein the compartment comprises two latches, one at each of the first and second ends of the cover.

23. A utility pole assembly comprising:

a hollow shaft;

a handhole in the side of the shaft;

a compartment in the handhole, the compartment comprising:

a sidewall forming an enclosure sized to be received in the handhole, the sidewall having a front edge that defines a front access opening; and at least one latch receiver in the sidewall;

a cover sized to occlude the front access opening, the cover having a body portion circumscribed by an edge;

a latch depending from the cover and comprising a foot movable between a latched position and an unlatched position, wherein in the latched position the foot non-threadedly engages the latch receiver in the sidewall to secure the cover over the access opening and so that in the unlatched position the foot is disengaged from the latch receiver.

24. The utility pole assembly of claim 23 wherein the latch further comprises a stem having an first end and a second end, wherein the first end is rotatably attached to the cover, wherein the foot extends from the second end of the stem.

25. The utility pole assembly of claim 24 wherein the foot is movable longitudinally along the stem and wherein the latch further comprises a coil spring on the stem between the cover and the foot whereby the foot is stabilized when in the unlatched position.

26. The utility pole assembly of claim 25 wherein the latch further comprises a head on the first end of the stem, the stem extending through cover so that the head is accessible from the top of the cover, and wherein rotation of the head results in movement of the foot between the latched position and the unlatched position.

27. The utility pole assembly of claim 26 wherein the stem is threadedly engaged with the foot so that when the foot is engaged in the latch receiver rotation of the head causes the foot to move up on the stem drawing the cover toward the sidewall, wherein the foot has a first end adapted to engage the latch receiver and a second end terminating in an extension member extending towards the cover, wherein the body portion of the cover has an inside surface, and wherein the extension member engages the inside surface of the cover when the cover is drawn toward the sidewall whereby the foot is stabilized.

28. The utility pole of claim 23 wherein the latch receiver is a slot.

29. The utility pole assembly of the claim 23 wherein the latch receiver is a protrusion extending inwardly from the sidewall.

30. The utility pole assembly of claim 23 wherein a lip depends from the edge of the cover.

31. The utility pole assembly of claim 23 wherein the sidewall has a read edge defining a rear opening.

32. The utility pole assembly of claim 31 wherein the compartment comprises a back plate that at least partially occludes the rear opening.

33. The utility pole assembly of claim 32 wherein the compartment comprises a terminal block supported on the back plate.

34. The utility pole assembly of claim 31 wherein the compartment comprises a terminal block supported inside the sidewall.

35. The utility pole assembly of claim 34 further comprising a traffic control device supported on the shaft, wherein the electrical wiring supplying the traffic control device is contained within the shaft, and wherein the wiring is connected to the terminal block.

36. The utility pole assembly of claim 23 wherein the cover is integrally formed of molded plastic.

37. The utility pole assembly of claim 23 wherein the shaft is vertically positioned.

38. The utility pole assembly of claim 37 further comprising a base for supporting the shaft.

* * * * *